US009520220B2

(12) United States Patent
Yen et al.

(10) Patent No.: US 9,520,220 B2
(45) Date of Patent: Dec. 13, 2016

(54) PARAMETER-VARIABLE DEVICE, VARIABLE INDUCTOR AND DEVICE HAVING THE VARIABLE INDUCTOR

(71) Applicant: REALTEK SEMICONDUCTOR CORP., Hsinchu (TW)

(72) Inventors: Hsiao-Tsung Yen, Hsinchu (TW); Yuh-Sheng Jean, Hsinchu (TW); Ta-Hsun Yeh, Hsinchu (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 69 days.

(21) Appl. No.: 14/505,812

(22) Filed: Oct. 3, 2014

(65) Prior Publication Data

US 2015/0348702 A1 Dec. 3, 2015

(30) Foreign Application Priority Data

Jun. 3, 2014 (TW) ..... 103119291 A

(51) Int. Cl.
*H01F 27/32* (2006.01)
*H01F 21/12* (2006.01)

(52) U.S. Cl.
CPC ..... *H01F 21/12* (2013.01); *H01F 27/32* (2013.01); *H01F 2021/125* (2013.01)

(58) Field of Classification Search
CPC ..... H01F 27/00–27/35
USPC ..... 336/84 M, 84 R, 94 C, 200, 232
See application file for complete search history.

(56) References Cited

U.S. PATENT DOCUMENTS 3,435,279 A * 3/1969 Boekhorst ..... H01F 38/42 315/406
3,449,661 A * 6/1969 Puidak ..... G01N 27/9053 324/225
7,460,001 B2 12/2008 Jessie
2012/0223796 A1 9/2012 Huang
2015/0102882 A1* 4/2015 Shudarek ..... H01F 37/00 336/10

FOREIGN PATENT DOCUMENTS

WO 2013086053 A1 6/2013

* cited by examiner

*Primary Examiner* — Tuyen Nguyen
(74) *Attorney, Agent, or Firm* — Tim Tingkang Xia, Esq.; Locke Lord LLP

(57) ABSTRACT

A device having a variable inductor includes an inductor having an inductance, a first conductor having a first grounding property, and a second conductor having a second grounding property. The device further includes a first single-mesh structure including a first grid. The first grid includes a first conducting wire electrically connected to the first conductor, and a second conducting wire electrically connected to the first conducting wire and the first conductor, wherein the first conducting wire, the second conducting wire and the first conductor are configured to form a first loop corresponding to the inductor for tuning the inductance. The first single-mesh structure further includes a second grid. The second grid includes a third conducting wire electrically connected to the first conducting wire and the second conductor, and a fourth conducting wire electrically connected to the third conducting wire and the second conductor, wherein the third conducting wire, the fourth conducting wire and the second conductor are configured to form a second loop corresponding to the inductor for tuning the inductance.

15 Claims, 12 Drawing Sheets

PARAMETER-VARIABLE DEVICE, VARIABLE INDUCTOR AND DEVICE HAVING THE VARIABLE INDUCTOR

CROSS-REFERENCE TO RELATED APPLICATION AND CLAIM OF PRIORITY

This application claims the benefit of Taiwan Patent Application No. 103119291, filed on Jun. 3, 2014, at the Taiwan Intellectual Property Office, the disclosures of which are incorporated herein in their entirety by reference.

TECHNICAL FIELD

The present disclosure is directed to a parameter-variable device, specifically directed to a variable inductor and a device having the variable inductor.

BACKGROUND

The technique of using an inductor is usually used in a voltage-controlled oscillator (VCO) including an inductor-capacitor resonator (LC Tank). When the semiconductor manufacturing process causes variations in, for example, the width, length, or oxide layer thinness of a transistor gate with the technology progress, a variable inductor can help to compensate for the variations.

Changing the inductance of an inductor can expand the tuning range of a VCO. In particular, the oscillation frequency of the VCO may require a millimeter wave design, and in this situation, the oscillation frequency may be larger than 30 GHz. In the past, the person skilled in the art tuned a metal oxide semiconductor capacitor (MOSCAP) to adapt to different wavelengths. For a millimeter wave design with a frequency larger than 30 GHz, the MOSCAP technique almost reaches the physical limit. The main reason is that with variations of the manufacturing process, such as the current 20 nm process, the line width decreases and the thickness of the metal layer in the lower layer also decreases. In addition, the higher the frequency is, the smaller the capacitance and inductance that are required. In the semiconductor manufacturing process, MOSCAPs are always formed in the lower metal layer so that resistance experienced by the MOSCAPs will increase quickly. Take the simplest RC series circuit for example, the quality factor, or Q factor, can be represented by $1/(\omega RC)$ wherein $\omega$ is angular frequency, R is resistance, and C is capacitance. In this situation, the effect of the capacitance variation on the tuning range will decrease, and, no matter how it is tuned, the Q factor cannot be effectively increased because the resistance is too large. Therefore, one may think about developing a variable inductor. For variable inductors, when inserting a switch between two inductors to serially connect the inductors, the equivalent inductance can be tuned by turning the switch on and off. However, the drawback of this method is that the resistance and inductance of the switch will be included in the series circuit and the overall performance will not approach the original inductor.

More details of the relevant prior art can be acquired from U.S. Pat. No. 7,460,001 and US Patent Application No. 20120223796.

SUMMARY

In view of the deficiencies in the prior art, one objective of the present disclosure is to provide a "parameter-variable electrical device and a device having the parameter-variable electrical device and a controlling method thereof", and provide parameter adjustment elements for currently existing electrical elements to at least solve the problems of system performance, such as when the tuning range of the inductor is fixed or too much Q factor is unnecessarily sacrificed.

Another objective of the present disclosure is to provide an element which is capable of improving the frequency characteristics, Q factor, phase noise performance, or signal synchronous transfer performance of the parameter-variable device.

Another further objective of the present disclosure is to provide an element which is capable of tuning the electrical parameters of the parameter-variable device without causing drastic changes to the manufacturing process.

The present invention can be a parameter-variable device including an electrical element having an electrical parameter, and a first conductor having a first grounding property. The parameter-variable device further includes a first conducting wire electrically connected to the first conductor and a second conducting wire electrically connected to the first conducting wire and the first conductor, wherein the first conducting wire, the second conducting wire, and the first conductor are configured to form at least a main part of a loop to tune the electrical parameter.

In addition, the present invention can also be an inductance tuning device for a variable inductor. The device includes a conductor having a grounding property. The device further includes a single-mesh structure including a grid, and the grid includes two conducting wires, wherein the two conducting wires electrically connect to the conductor and are configured to form a loop with the conductor to tune an inductance of the variable inductor.

The present invention can further be a device having a variable inductor which includes an inductor having an inductance, a first conductor having a first grounding property, and a second conductor having a second grounding property. The device further includes a first single-mesh structure including a first grid. The first grid includes a first conducting wire electrically connected to the first conductor and a second conducting wire electrically connected to the first conductor and the first conducting wire, wherein the first conducting wire, the second conducting wire and the first conductor are configured to form a first loop corresponding to the inductor for tuning the inductance. The first single-mesh structure further includes a second grid. The second grid includes a third conducting wire electrically connected to the first conductor and the second conductor, and a fourth conducting wire electrically connected to the second conductor and the third conducting wire, wherein the third conducting wire, the fourth conducting wire and the second conductor are configured to form a second loop corresponding to the inductor for tuning the inductance.

The efficacy and purposes of the present disclosure can be further understood through the following detailed descriptions.

BRIEF DESCRIPTIONS OF DRAWINGS

DETAILED DESCRIPTION

The present disclosure can be fully understood and accomplished by the skilled person according to the following embodiments. However, this description is only for the purpose of illustration rather than limiting the present invention.

The following will illustrate preferable embodiments of parameter-variable electrical devices and devices having the parameter-variable electrical devices and the controlling methods thereof. However, the practical structures and adopted methods do not need to be completely identical to the described structures and methods. The skilled persons in the art are definitely able to make various modifications and amendments within the practical spirit and scope of the present invention. To facilitate the description of technical content in the present disclosure, the same element in each embodiment generally uses the same reference sign.

Figure 1A:
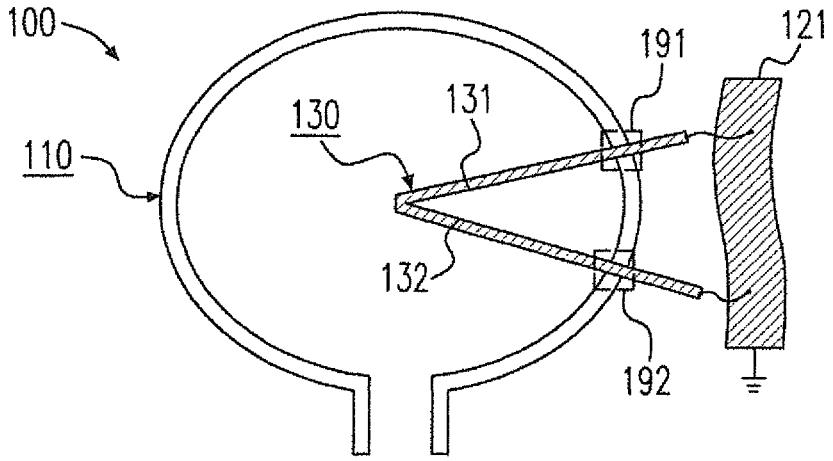
FIG. 1A is a top view diagram showing a preferable embodiment of a parameter-variable device according to the present disclosure.

Please refer to FIG. 1A, a top view diagram showing a preferable embodiment of a parameter-variable device according to the present disclosure. The parameter-variable device 100 includes an electrical element 110 having an electrical parameter and a first conductor 121 having a first grounding property. The parameter-variable device 100 further includes a first conducting wire 131 electrically connected to the first conductor 121, and a second conducting wire 132 electrically connected to the first conducting wire 131 and the first conductor 121, wherein the first conducting wire 131, the second conducting wire 132, and the first conductor 121 are configured to form at least a main part of a loop to tune the electrical parameter. In the configuration shown in FIG. 1A, at least two advantages can be achieved. First, it is capable of sufficiently and effectively utilizing the area enclosed by the loop to finely tune the electrical parameter of the electrical element 110. The reason is that the loop is not limited to those loops formed by utilizing the connection of a switch and conducting wires in the prior art but is formed by the first conductor 121 having the first grounding property. Second, reducing the impact of parasitic capacitors so that the frequency characteristic, Q factor of the parameter-variable device 100 will not be overly sacrificed at the very beginning because of the parasitic capacitors. Take the electrical element 110 in FIG. 1A for example, because at the beginning, only the first conducting wire 131, second conducting wire 132, and the first conductor 121 are used to form a loop, the dominant parts that result in parasitic capacitors are only the parasitic capacitors 192 and 193 closest to the electrical element 110, wherein a switch or an element having a function related to a switch can be disposed between the connection from either conducting wire 131 or conducting wire 132 to the first conductor 121 to perform the switching function. Clearly, the loop formed by the first conducting wire 131 and the second conducting wire 132 is a configuration capable of sufficiently and effectively utilizing the enclosed area as well as substantially reducing the impact of the parasitic capacitors. In a preferable embodiment, combining a smaller line width with it (e.g. lower than 5 micrometers) is one of the most preferable configurations that minimize the number of parasitic capacitors. Therefore, the frequency characteristics and Q factor of the parameter-variable device 100 are better than those of the prior art and furthermore, the tuning range of the electrical parameter will not be narrowed.

Clearly, the applicability of the parameter-variable device 100 is very extensive. The parameter-variable element 110 can be any electrical element having an electrical parameter required to be finely tuned. For example, one can apply the element in semiconductor or non-semiconductor structure, or as an inductor in an inductor-capacitor tank, RF choke, matching network or voltage-controlled oscillator.

Moreover, the first conductor 121 having the first grounding property is significant because it has importance in improving the efficacy of the parameter-variable device 100. Usually, the first conductor 121 is a grounding terminal, which means that it is at least a conductor capable of enduring large current, either a direct current ground (DC Ground) or an alternating current ground (AC Ground). Take the semiconductor structure as an example, it can be but is not limited to the ground layer located in a metal layer (e.g. M1 layer), and it can also connect to the power supplies VDD and VSS, or even connect to a guard ring. The configuration of the first conductor 121 can not only achieve the goal of forming a current loop with the first conducting wire 131 and the conducting wire 132, but also reduce the required metal conducting wires near the electrical element 110 so as to help in reducing the number of parasitic capacitors. In addition, the grounding terminal is extensively distributed in the semiconductor structure, so for a device achieving the goal of the embodiment disclosed in FIG. 1A, the first conductor 121 is a better choice because the configuration thereof can be implemented by line bonding or current guiding techniques in an area able to connect to the grounding terminal without causing drastic changes to the manufacturing process.

In addition, where the first conducting wire 131, the second conducting wire 132, and the first conductor 121 are configured to form at least a main part of a loop means that the loop can be one hundred percent formed by the first conducting wire 131, the second conducting wire 132, and the first conductor 121, for example, a loop formed in a triangle or a shape structure similar to a triangle. In other feasible embodiments, the first conducting wire 131, the second conducting wire 132, and the first conductor 121 can also be the shape of other polygons. In this situation, the part area of loop structure 130 can be a percentage of twenty, forty, sixty, eighty of inductor of 110 or other percentages. For most cases of structure 130 designs with around 40-80 percent of the area of inductor 110. Furthermore, a loop plane of the loop defined by the first conducting wire 131 and the second conducting wire 132 can be non-parallel to the plane where the electrical element 110 is located, and can be inclined by various angles according to design demands.

It should be noted that the first conducting wire 131 and the second conducting wire 132 can also be lines in an arc shape or other shape as long as they can cooperate with the first conductor 121 to achieve certain technical effect and they are within the scope of the embodiments.

Figure 1B:
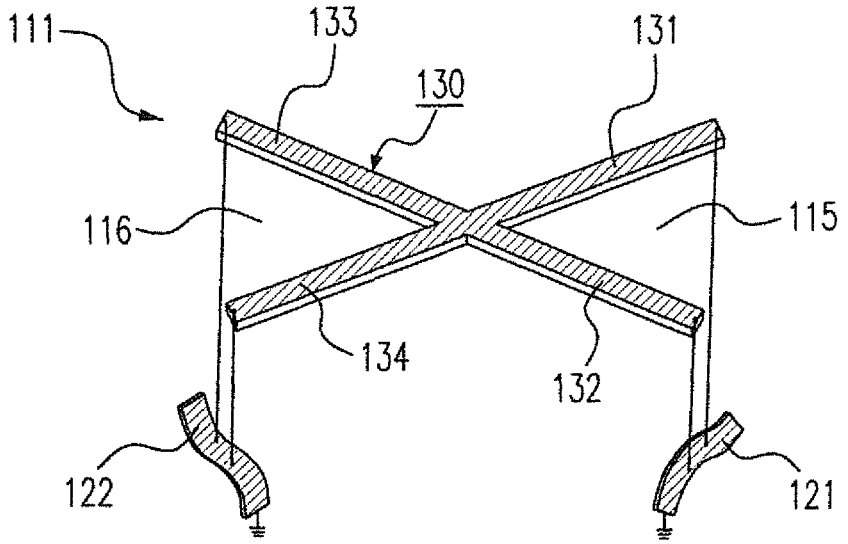
FIG. 1B is a three dimensional diagram showing a preferable embodiment of a parameter-tuning device according to the present disclosure.

Following the discussion of FIG. 1A, please now refer to FIG. 1B, a diagram showing a preferable embodiment of a parameter-tuning device of the parameter-variable device 100 from another view of FIG. 1A. In this embodiment, the parameter-variable device 100 can be a variable inductor. An inductance tuning device 111 of the variable inductor 100 includes a conductor 121 having a grounding property. The inductance tuning device 111 further includes a single-mesh structure 130 including a grid 115, and the grid 115 is formed by the two conducting wires 131 and 132, wherein each of the two conducting wires 131 and 132 is electrically connected to the conductor 121 and configured to form a loop with the conductor 121 to tune an inductance of the variable inductor 100.

In addition, the inductance tuning device 111 can further include another conductor 122 having a grounding property identical to or different from that of the first conductor 121. The single-mesh structure 130 includes another grid 116, wherein each of the grids 115, 116 is formed by two conducting wires, i.e. the pair 131 and 132, and the pair 133 and 134, and the conducting wires are respectively electrically connected to the conductors 121 and 122 to form two loops to tune an inductance of the variable inductor 100. The embodiment of FIG. 1B, through the single-mesh structure 130, is capable of sufficiently and effectively utilizing areas enclosed by the loops as well as varying an inductance of an inductor by selecting different shapes, sizes, locations of the grids 115 and 116 according to different demands. Moreover, the increased number of the dominant parasitic capacitors is still low and, there may be four or fewer in the embodiment in FIG. 1B.

Figure 1C:
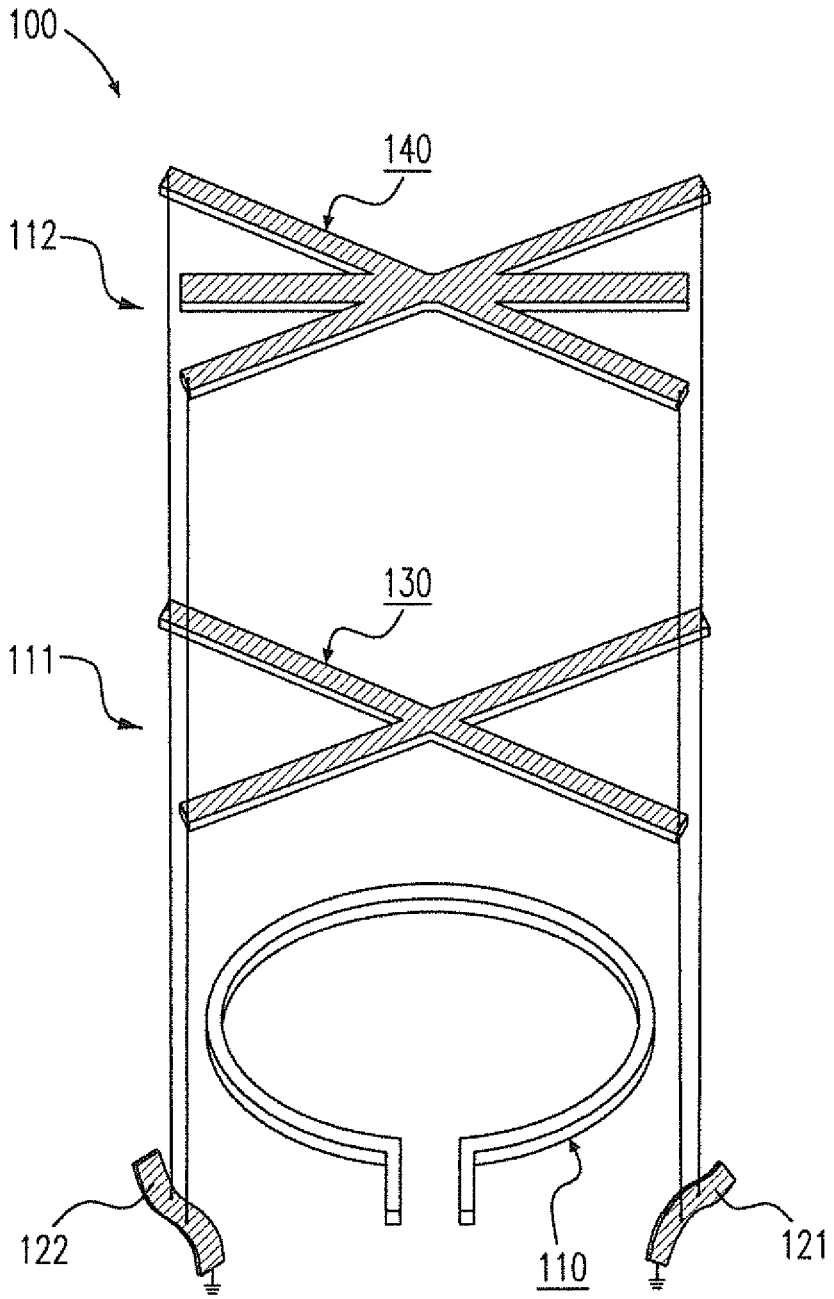
FIG. 1C is a three dimensional diagram showing another preferable embodiment of a parameter-variable device according to the present disclosure.

FIG. 1C is a three dimensional diagram showing another preferable embodiment of a further improved parameter-variable device according to FIG. 1A and FIG. 1B. The inductor 100 can include another inductance tuning device 112 including another single-mesh structure 140, for example in a radial shape, connected in parallel with the single-mesh structure 130 to jointly tune the inductance with the single-mesh structure 130. Take a semiconductor structure for example, the single-mesh structures 130, 140 can be located in different metal layers and mutually electrically connected by plural conducting wires formed through the technique of via holes or the like. In this embodiment, the single-mesh structures 130, 140 can jointly tune the inductance of the inductor 100, which results in more flexible and precise inductance tuning. Certainly, providing more parallel connection structures of the single-mesh structures will result in more complex inductance tuning. Structure of FIG. 1A, FIG. 1B and FIG. 1C may generally with a range for metal width and spacing, when designing for a best case. Metal width cannot be too narrow for making eddy current, in order to make effects on inductor 110. Ether cannot be too wide for suffer too much Q for inductor 110. Width is around 1 um to 5 um is the best case as well as 50 um to 200 um for spacing.

Figure 2A:
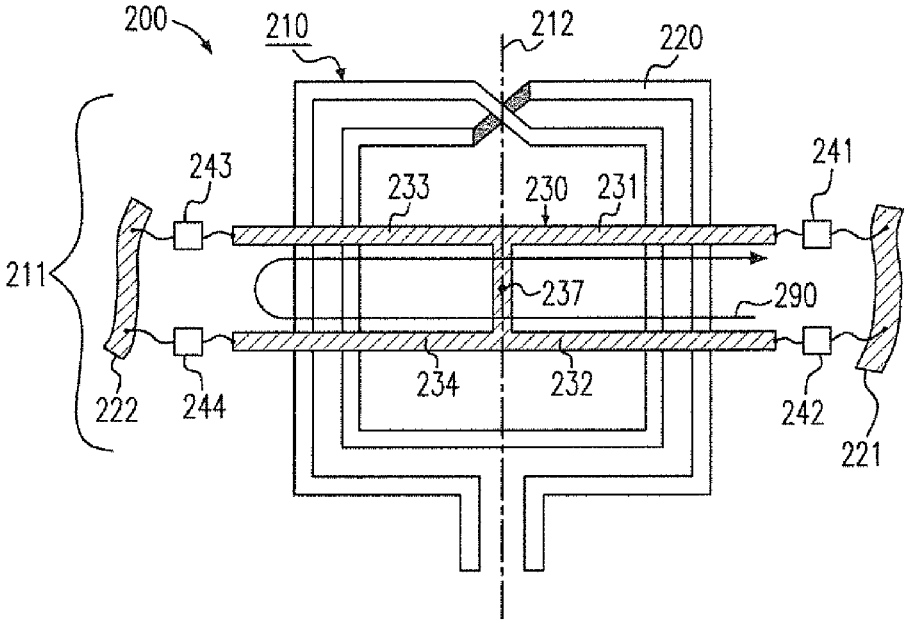
FIG. 2A is a top view diagram showing a preferable embodiment of a variable inductor according to the present disclosure.

FIG. 2A is a top view diagram showing a preferable embodiment of a variable inductor according to the present disclosure. A variable inductor 200 has a single-mesh structure 230 and an inductance. The inductance-tuning device 211 of the variable inductor 200 further includes a first control element 241 electrically connected between the first conducting wire 231 and the first conductor 221 to selectively control a current flowing from the first conducting wire 231 to the first conductor 221, e.g. controlling the magnitude of the current. The variable inductor 200 further includes a second control element 242 electrically connected between the second conducting wire 232 and the first conductor 221 to selectively control a current flowing from the second conducting wire 232 to the first conductor 221, e.g. controlling the magnitude of the current. The variable inductor 200 further includes a second conductor 222 having a second grounding property, wherein the second conductor 222 is electrically connected between the first conducting wire 231 and the second conducting wire 232 and configured to form the loop with the first conducting wire 231, the second conducting wire 232, and the first conductor 221 to tune the inductance. The first control element 241 and the second control element 242 can be one of a transistor, a complementary metal-oxide-semiconductor field effect transistor, a variable capacitor, a diode, and any combination thereof. This embodiment further improves the device in FIG. 1A and FIG. 15 through the first control element 241 and the second control element 242.

Specifically, assuming the first control element 241 and the second control element 242 are transistors, a preferable controlling method for the inductance-tuning 211 includes Step 1: switching on the transistors 241 and 242, so that the single-mesh structure 230 generates an induced current 290 flowing in the loop of the single-mesh structure 230 through the eddy current effect to vary the inductance. Step 2: switching off the transistors 241 and 242 so that the single-mesh structure 230 does not form a conducting loop, and does not generate the induced current, and the inductance is almost unchanged. In this configuration, one can more flexibly and precisely tune the inductance of the inductor 210. In another embodiment, one of the first control element 241 or the second control element 242 can be omitted and directly electrically connected to the first conductor 221. It should be noted that the steps of this controlling method do not have a necessary order, so the skilled person in the art can properly make arbitrary modifications according to the same invention concept.

In addition, if variable capacitors are applied as the first control element 241 and the second control element 242, a similar technical effect can be achieved. For example, in an alternating circuit, when tuning to large capacitances, the variable capacitors are equivalent to a switch switching on or in a closed loop; when tuning to small capacitances, the variable capacitors are equivalent to a switch switching off or in an open loop. Variable capacitor here is generally with a variation may from 0.5 pH to 3 pH for a best case. The design of this device is depend to the applied frequency. Lower frequency needs larger capacitance.

It should be noted that the size of the single-mesh structure 230 can be varied according to different design demands. For example, the formed area of the loop can have a projection overlapping twenty five, fifty, seventy five, or one hundred percent of the area of the coil 220 of the variable inductor 200. These different percentages depend on the demanded accuracy and precision of the device. Certainly, forty and sixty percent may be preferable choices because the precision can reach a suitable level and be compatible with other more complex designs of the single-mesh structure 230.

Furthermore, the shape of the inductor 210 can be a circle, tetragon, octagon, or other different shape, and can also be in a symmetrical or asymmetrical shape.

Figure 2B:
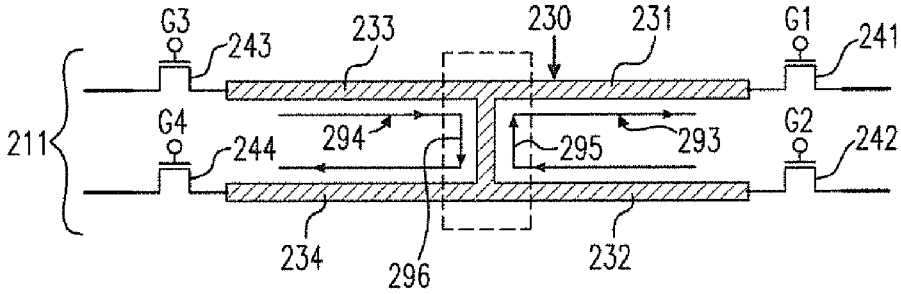
FIG. 2B is a top view diagram showing a preferable embodiment of a single-mesh structure of a variable inductor according to the present disclosure.

FIG. 2B is a top view diagram showing a preferable embodiment of a single-mesh structure of a variable inductor according to the present disclosure. Assuming the inductor 210 of FIG. 2A is symmetrical from the left side to the right side and includes a central axis 212, the central axis 212 symmetrically partitions the inductor interior area into a left area and a right area. The first single-mesh structure 230 further includes a central axis/mesh conducting wire 237 aligned with and parallel to the central axis 212. In addition, each of the first conducting wire 231 and the second conducting wire 232 extends in a direction perpendicular to the central axis/mesh conducting wires 237, from the central axis/mesh conducting wire 237, both through the left area and right area, to the inductor exterior area. Therefore, the central axis/mesh conducting wires 237 can partition the single-mesh structure 230 into two symmetrical loops. The inductance-tuning device 211 can further include a third control element 243 electrically connected between the first conducting wire 231 and the second conducting wire 222, and a fourth control element 244 electrically connected between the second conducting wire 232 and the second conducting wire 222.

In the configuration shown in FIG. 2B, a preferable controlling method for the inductor-tuning device 211 includes Step 1: adjusting the transistor gates G1, G2, G3, G4 to switch on the transistors 241, 242, 243 and 244 and cause the single-mesh structure 230 to generate induced current 293 and 294 through the eddy current effect. At this time, the two loops simultaneously tune the inductance of the inductor 210, so the variance of the inductance is largest. Step 2: adjusting the transistor gates G1, G2, G3, G4 to switch on one of the pair of transistors 241 and 242 or the pair of transistors 243 and 244, and switch off at least one transistor of the other pair so that a left conducting loop or a right conducting loop is formed in the single-mesh structure 230. At this time, only one loop tunes the inductance of the inductor 210, so the variance of the inductance is smaller. Step 3: adjusting the pair of transistor gates G1, G2 and the pair of transistor gates G3, G4 to switch off at least one transistor of the pair of transistors 241 and 242, and switch off at least one transistor of the pair of transistors 243 and 244 so that no conducting loop is formed in the single-mesh structure 230, and basically no induced current can be formed and the inductance is almost not varied. It should be noted that the steps of this controlling method do not have a necessary order, so the skilled person in the art can properly make arbitrary modification according to the same invention concept.

In one embodiment, the conductors 221 and 222 can belong to connected or separate circuit connections. Moreover, in another specific embodiment, the mesh conducting wire 237 can be omitted to achieve a different efficacy of tuning the inductance.

In the situation that the single-mesh structure 230 in FIG. 2B is symmetrical from left to right, the currents 295 and 296 flowing through the mesh conducting wire 237 can mutually offset or cancel each other and cause the mesh conducting wire 237 to be equivalent to a open loop. In theory and practice, it can be proven that the single-mesh structure 230 causing the currents 295 and 296 to mutually offset each other can avoid phase noise. In other words, under this essential discovery, the configuration of the mesh conducting wire 237 can more flexibly and precisely tune the inductance of the inductor 210 through the control of the transistor pairs 241/242 and 243/244 without affecting the original efficacy of the variable inductor 200.

In addition, the transistor pairs 241/242 and 243/244 can be configured by electrically connecting a digital control circuit (not shown) to the transistor gates G1, G2, G3, and G4 so as to control the transistors to vary the inductance of the inductor 210 in a digital way according to different demands.

In another embodiment, any of the control elements 241, 242, 243, or 244 can be omitted or can be directly electrically connected to the conductor 221 or conductor 222. Furthermore, each of the first conducting wire 231 and the second conducting wire 232 preferably can be a straight conducting wire and straightly extending from the inductor interior area to the inductor exterior area so that the first conducting wire 231 and the second conducting wire 232 are respectively electrically connected with the first conductor 221.

Figure 3A:
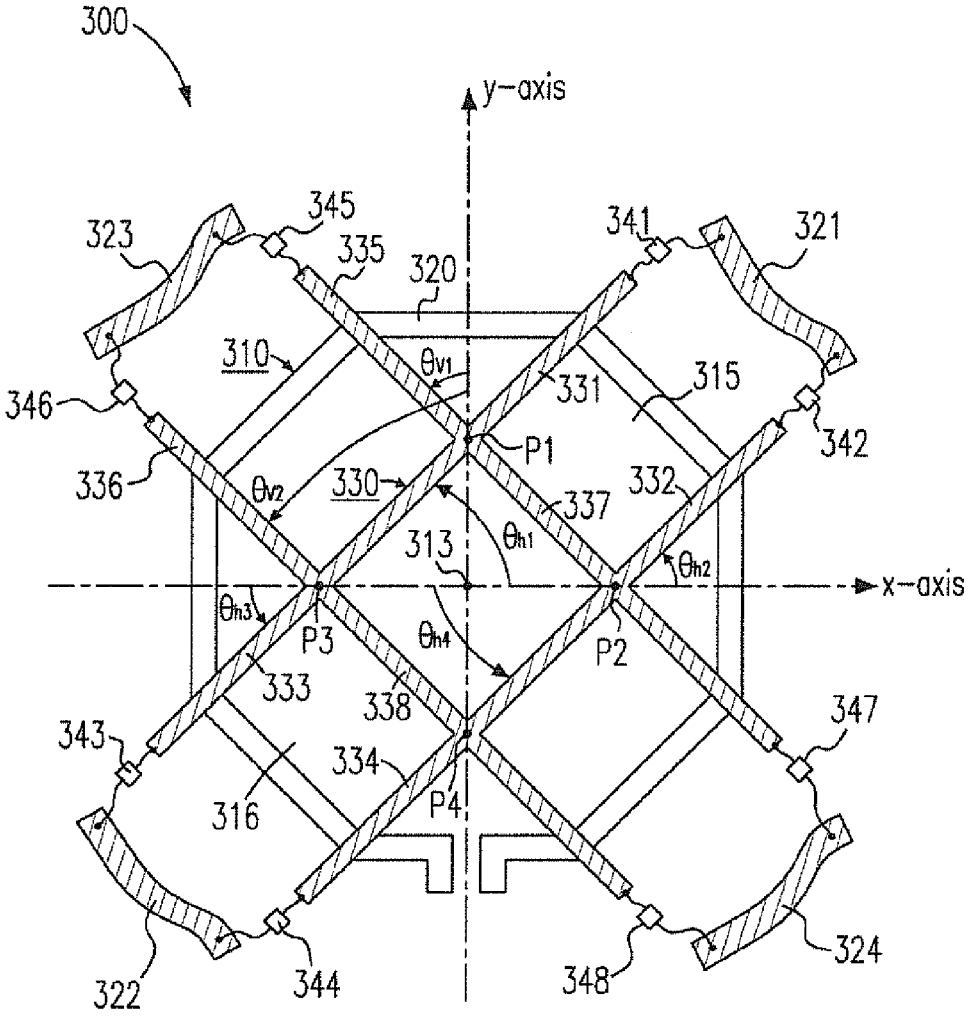
FIG. 3A is a top view diagram showing a preferable embodiment of a device having a variable inductor according to the present disclosure.

FIG. 3A is a top view diagram showing a preferable embodiment of a device having a variable inductor according to this disclosure. A device 300 having a variable inductor includes an inductor 310 having an inductance. The device 300 further includes a first conductor 321 having a first grounding property, and a second conductor 322 having a second grounding property. The device 300 further includes a first single-mesh structure 330 including a first grid 315, The first grid 315 includes a first conducting wire 331 electrically connected to the first conductor 321 through a first control element 341, and a second conducting wire 332 electrically connected to the first conducting wire 331 and electrically connected to the first conductor 321 through a second control element 342. The first conducting wire 331, the second conducting wire 332 and the first conductor 321 are configured to form a first loop corresponding to the inductor 310 for tuning the inductance. The first single-mesh structure 330 further includes a second grid 316. The second grid 316 includes a third conducting wire 333 electrically connected to the first conducting wire 331 and electrically connected to a second conductor 322 through a third control element 343, and a fourth conducting wire 334 electrically connected to the third conducting wire 333 and the second conductor 322. The third conducting wire 333, the fourth conducting wire 334 and the second conductor 322 are configured to form a second loop corresponding to the inductor 310 for tuning the inductance.

In some embodiments, the conductor 321, 322, 323, and 324 can be the same conductor, wiring lines mutually electrically connected by vias or separate wiring lines, or be located in the same or different semiconductor metal layers. For example, such conductors can be electrically connected to power supplies VDD, VSS, or even connected to guard rings.

Figure 3B:
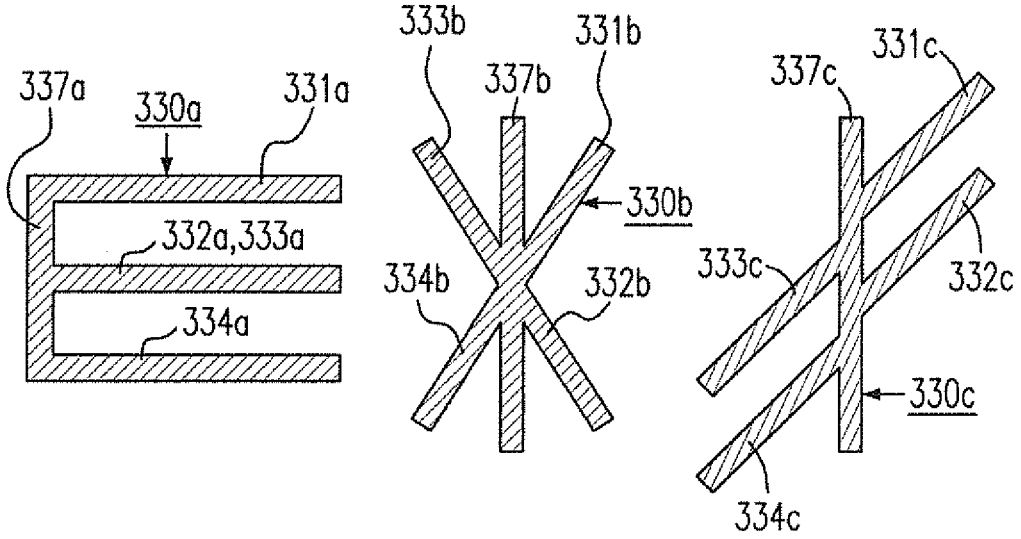
FIG. 3B is a top view diagram showing different embodiments of a single-mesh structure according to the present disclosure.

FIG. 3B is a top view diagram showing different embodiments of a single-mesh structure 330 according to Fig. A. Take single-mesh structure 330*a* for example, the third conducting wire 333*a* and the second conducting wire 332*a* are the same conducting wire or merged with each other. In this situation, the first conductor 321 and the second conductor 322 can be commonly grounded. The single-mesh structure 330*b* is a radial structure, and the single-mesh structure 330*c* is another type of single-mesh structure.

Figure 3C:
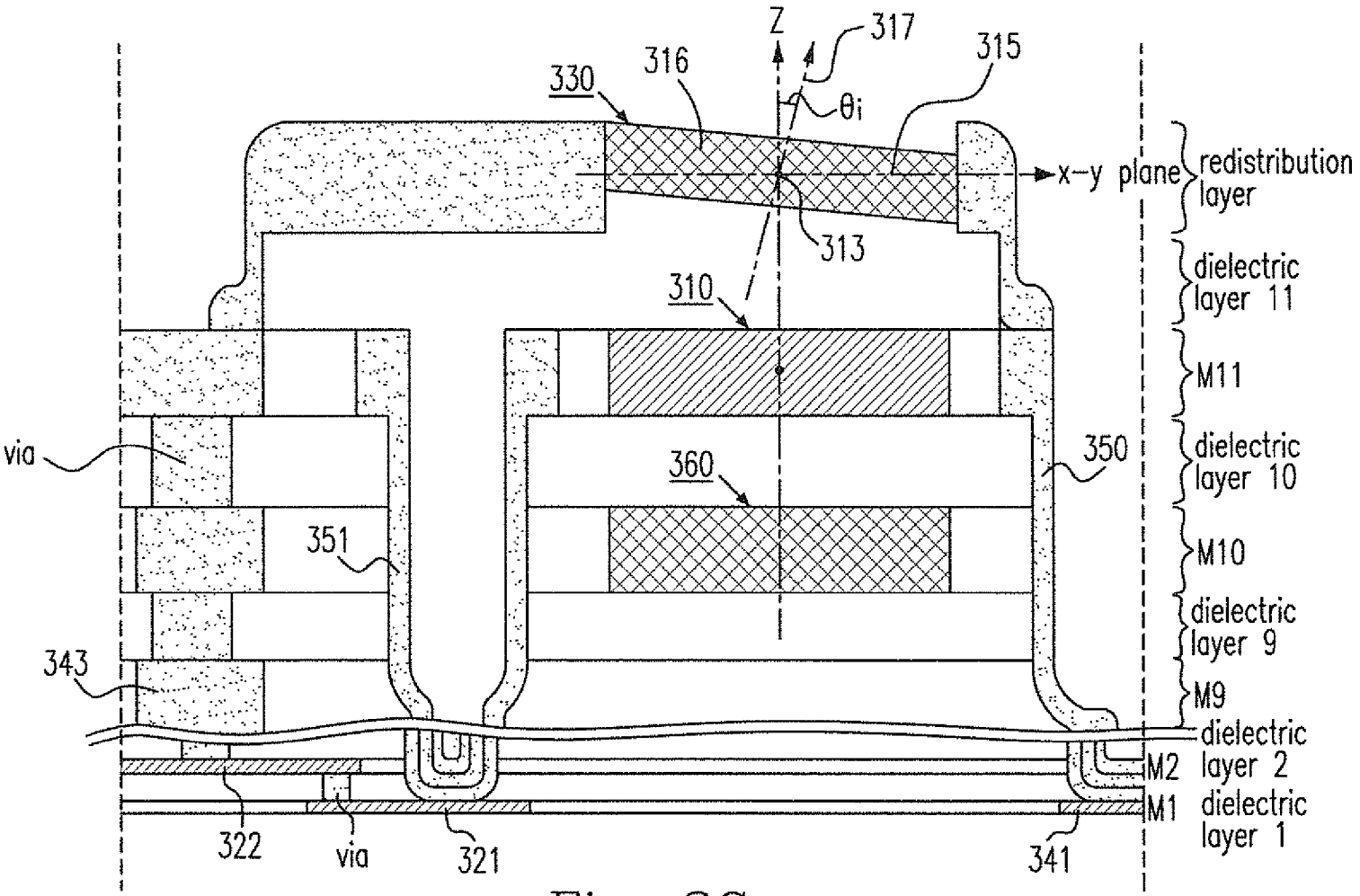
FIG. 3C is a side view diagram showing a preferable embodiment of a device having a variable inductor according to the present disclosure.

Please refer to FIG. 3A and FIG. 3C. The inductor 310 of a device 300 having a variable inductor includes at least one coil 320 enclosing a closed area and defining an xy-plane, wherein the xy-plane is spaced and parallel with the closed area and has a center 313. In addition, a z-axis passes through the center 313 and is perpendicular to the xy-plane. The first grid 315 further includes an inclined plane 316 defined by the first conducting wire 331 and the second conducting wire 332, and an inclined axis 317 perpendicular to the inclined plane 316, and deviating from a positive end of the z-axis toward the xy-plane so as to form an inclined axis angle $\theta_i$ between the inclined axis 317 and the z-axis, wherein $\theta_i$ from −90° to 90°, or preferably ranges from −45° to 45°. This embodiment illustrates that the first single-mesh structure 330 is not necessarily parallel to an inductor according to particular design demands. However, in consideration of convenience of the manufacturing process and stability of efficacy from a symmetrical structure, $\theta_i$ is preferably 0°, and if the single-mesh structure 330 can be symmetrical from left to right along with the y-axis in FIG. 3A, it is a more preferable choice. Especially, under the design of a radial structure of a single-mesh structure 330, choosing a circle inductor 310 and the single-mesh structure 330 that jointly forms a circular symmetrical structure is one of the most preferable choices for the variable inductor 300. This is because each conducting wire of the single-mesh structure 330 is perpendicular to the coil 320 of the inductor 310 (when viewed from the top), so the overlapping area of the single-mesh structure 330 and the coil 320 can be minimized, the parasitic capacitance can be minimized, and the Q factor performance can be improved.

In a situation where $\theta_i$ not equal to 0°, two methods can be implemented to reach this goal. The first method uses the manufacturing process of a micro-electro mechanical system (MEMS). The second method is mainly used when the variable inductor is manufactured in the process of logic circuits, wherein its implementation is similar to that in FIG. 1C by adopting a plurality of metal layers to stack a plurality of spatially graduated single-mesh structures and then interconnect the plurality of single-mesh structures by vias to form a stair-shaped structure within the plurality of metal layers.

In another preferable embodiment, the xy-plane has an x-axis passing through the center 313 and located on the xy-plane, and a y-axis passing through the center 313, located on the xy-plane and perpendicular to the x-axis. The first grid 315 can further include a first vertical straight conducting wire 335 (not limited to a top-down or bottom-up direction) deviating from a positive end of the y-axis toward the negative end of the x-axis so as to form a first vertical angle $\theta_{v1}$ between the first vertical straight conducting wire 335 and the y-axis, and has a first grid point P1 and a second grid point P2. In addition, the first conducting wire 331 can be a first horizontal straight conducting wire (not limited to a left-right or right-left direction) deviating from the positive end of the x-axis toward the positive end of the y-axis so as to form a first horizontal angle $\theta_{h1}$ between the first horizontal straight conducting wire 331 and the x-axis, extending from the first grid point P1 and electrically connected to the first conductor 321. The second conducting wire 332 is a second horizontal straight conducting wire (not limited to a left-right or right-left direction) deviating from the positive end of the x-axis toward the positive end of the y-axis so as to form a second horizontal angle $\theta_{h2}$ between the second horizontal straight conducting wire 332 and the x-axis, extending from the second grid point P2 and electrically connected to the first conductor 321.

Similarly, the second grid 316 can further include a second vertical straight conducting wire 336 (not limited to a top-down or bottom-up direction) located on the xy-plane, spaced and parallel with the first vertical conducting wire 335. The second vertical straight conducting wire 336 deviates from the positive end of the y-axis toward the negative end of the x-axis so as to form a second vertical angle $\theta_{v2}$ between the second vertical straight conducting wire 336 and the y-axis, and has a third grid point P3 and a fourth grid point P4. The third conducting wire 333 can be a third horizontal straight conducting wire (not limited to a left-right or right-left direction) deviating from the negative end of the x-axis toward the negative end of the y-axis so as to form a third horizontal angle $\theta_{h3}$ between the third horizontal straight conducting wire 333 and the x-axis, and extending from the third grid point P3 and electrically connected to the second conductor 322; the fourth conducting wire 334 can be a fourth horizontal straight conducting wire (not limited to a left-right or right-left direction) deviating from the negative end of the x-axis toward the negative end of the y-axis so as to form the fourth horizontal angle $\theta_{h4}$ between the fourth horizontal straight conducting 334 wire and the x-axis, and extending from the fourth grid point P4 and electrically connected to the second conductor 322, wherein each of $\theta_{v1}$, $\theta_{v2}$, $\theta_{h1}$, $\theta_{h2}$, $\theta_{h3}$, and $\theta_{h4}$ ranges from −90° to 90°, or preferably ranges from −45° to 45°. This embodiment illustrates that there are various planar structures of the single-mesh structure 330 according to different design demands. However, in consideration of the convenience of the manufacturing process and stability of efficacy from a symmetrical structure, setting $\theta_{v1}$, $\theta_{v2}$, $\theta_{h1}$, $\theta_{h2}$, $\theta_{h3}$, and $\theta_{h4}$ at 0° is still one of the most preferable choices.

In addition, the vertical straight conducting wires 335 and 336 can be further electrically connected to one of the control elements 345, 346, 347, and 348 or directly electrically connected to the conductors 323 and 324 having grounding properties. In this embodiment, the first single mesh-structure 330 in FIG. 3A can flexibly tune the inductance of the inductor 310 with different combinations through the control of a digital control circuit.

In another embodiment, a second single-mesh structure 360 which can have a structure the same as or different from that of the first single-mesh structure 330, and spaced with and parallel or unparallel to the first single-mesh structure 330 so that the inductor 310 is located between the first single-mesh structure 330 and the second single-mesh structure 360 to further tune the inductance. This embodiment can not only increase the tuning range of the inductor, but also obtain a preferable embodiment if one locates the first single-mesh structure 330, the second single-mesh structure 360 and the inductor 310 respectively in adjacent metal layers. Taking a semiconductor structure for example, they can be respectively located in a distribution layer, a metal layer M11, and a metal layer M10 or one layer above than that of the inductor by a general rule of deploying them above the inductor so as to achieve a preferable configuration (wherein, there are usually dielectric layers between every two metal layers in the figure, such as dielectric layer 11, dielectric layer 10, etc.) The reason for doing so is that the thickness of an upper metal layer is thicker in the typical modern semiconductor structure, for example, the thickness of the distribution layer can range from 1.0 μm to 3.0 μm (micron meter), and M10 and M11 can also be 1.0 μm to 4.0 μm. In contrast, the thickness of a lower metal layer can range from 0.05 μm to 0.5 μm. Therefore, the resistance of an upper metal layer is much smaller than that of a lower metal layer, and if the inductor 310 is disposed in the upper metal layer, unnecessary energy loss can be reduced, and the Q factor performance will improve. In addition, the smaller resistance the of upper metal layer can allow the induced current generated by the eddy current effect in the single-mesh structures 330 and 360 to be larger, so that a larger induced magnetic flux can be generated and the variation of the inductance of the inductor 310 can be more apparent. This configuration of the embodiment can be applied to all the embodiments having single-mesh structures according to the present disclosure.

In a preferable embodiment, when viewed from the top of the inductor 310, the first conductor 321 and the second conductor 322 are located in the inductor exterior area, and each of the first conducting wire 331, the second conducting wire 332, the third conducting wire 333, and the fourth conducting wire 334 is a straight conducting wire extending from the inductor interior area to the inductor exterior area, and the inductor interior area includes non-overlapping cross section areas projected by the first grid 315 and the second grid 316 in the inductor interior area. One of the benefits to do so is, the conducting wires electrically connected to the conductors 321 and 322 will not affect the inducing effect of the inductor interior area which performs the eddy current effect, and the cross section areas of the first grid 315 and the second grid 316 can be effectively utilized to enhance the inducing effect.

In another preferable embodiment, the inductor 310 is symmetrical from left to right and includes a central axis (for example, spaced and aligned with the y-axis) symmetrically partitioning the inductor interior area into a left area and a right area. The first single-mesh structure 330 further includes a mesh/central axis conducting wire aligned with and parallel to the central axis (for example, coinciding with the y-axis and $\theta_{v1}$ is 0°). Each of the first conducting wire 331 and the second conducting wire 332 extends in a direction perpendicular to the mesh conducting wire, from the mesh conducting wire, through the right area, to the inductor exterior area, and each of the third conducting wire 333 and the fourth conducting wire 334 extends in a direction perpendicular to the mesh conducting wire, from the mesh conducting wire, through the left area, to the inductor exterior area. The benefit of this embodiment is that the symmetry of the inductor 310 and the first single-mesh structure 330 can be kept, so that the frequency characteristics, Q factor, phase noise performance, or signal synchronous transfer performance will improve.

Please again refer to FIG. 3C. The device 300 having a variable inductor can further include a metal layer (e.g., M11) including the inductor 310, a ground layer (e.g. M1) located below the metal layer M11 and including the first conductor 321 having a grounding property, the control element 341 and the second conductor 322, the control element 343 (control element 342, 344, 345, 346, 347, and 348 can also be included but are not shown in the figure). The device 300 can further include a first guard ring 350 located between the metal layer M11 and the ground layer M1 and electrically connected to the ground layer M1, wherein the first conducting wire 331 and the second conducting wire 332 are electrically connected to the first guard ring 350. This embodiment is important because it can reduce the number of changes in the manufacturing process. Specifically, although this disclosure presents the idea of introducing the first conductor 321 and the second conductor 322 to improve the efficacy, it might cause a potential variation in the manufacturing process. For example, it may be necessary to add a via conducting wire around the single-mesh structure 330 to electrically connect the single-mesh structure 330 to the second conductor 322, control elements 343, 344 in the lower layer, etc. However, if one can utilize the first guard ring 350 which has already been electrically connected to the ground layer in the semiconductor structure, one can directly connect the conducting wires 331 and 332 required to be grounded to the first guard ring 350 near the first single-mesh structure 330 to achieve the goal. However, in a preferable embodiment, the first guard 350 is a large guard ring connected through several metal layers, for example, it is continuously connected from the metal layer M11 to ground layer M1 through a stack of a plurality of metals within the layers below. The benefit is that the thickness of the first guard ring 350 is thicker and the resistance is smaller, so the impact to the tuning range of the single-mesh structure 330 and the inductance of the inductor 310 is also smaller. It should be noted that the metal layer M11 only represents the preferable location of the guard ring, so in other embodiments, the guard rings in M6, M7, M8, M9, or M10 and even a redistribution layer are also possible. The configuration of this embodiment can be applied to all the embodiments having single-mesh structures according to the present disclosure.

In another preferable embodiment, the metal layer further includes a second guard ring 351 surrounding the inductor 310. The purpose of the second guard ring 351 is to prevent the inductor 310 from being affected by the parasitic or coupling effect of other electrical elements or conducting wires. In addition, in the embodiment using a second single-mesh structure 360, the second guard ring 351 also can serve as a medium to electrically connect the second single-mesh structure 360 to a conductor having a grounding property (e.g. conductor 321, 322 or other conductors). In yet another preferable embodiment, the first guard ring 350 and the second guard ring 351 also can be the same guard ring. The configuration of this embodiment can be applied to all the embodiments having multiple single-mesh structures according to the present disclosure.

In another embodiment, the conductors 321 and 322 can be located in different metal layers (e.g. M1 and M2), and can be connected with each other through a via.

Figure 4:
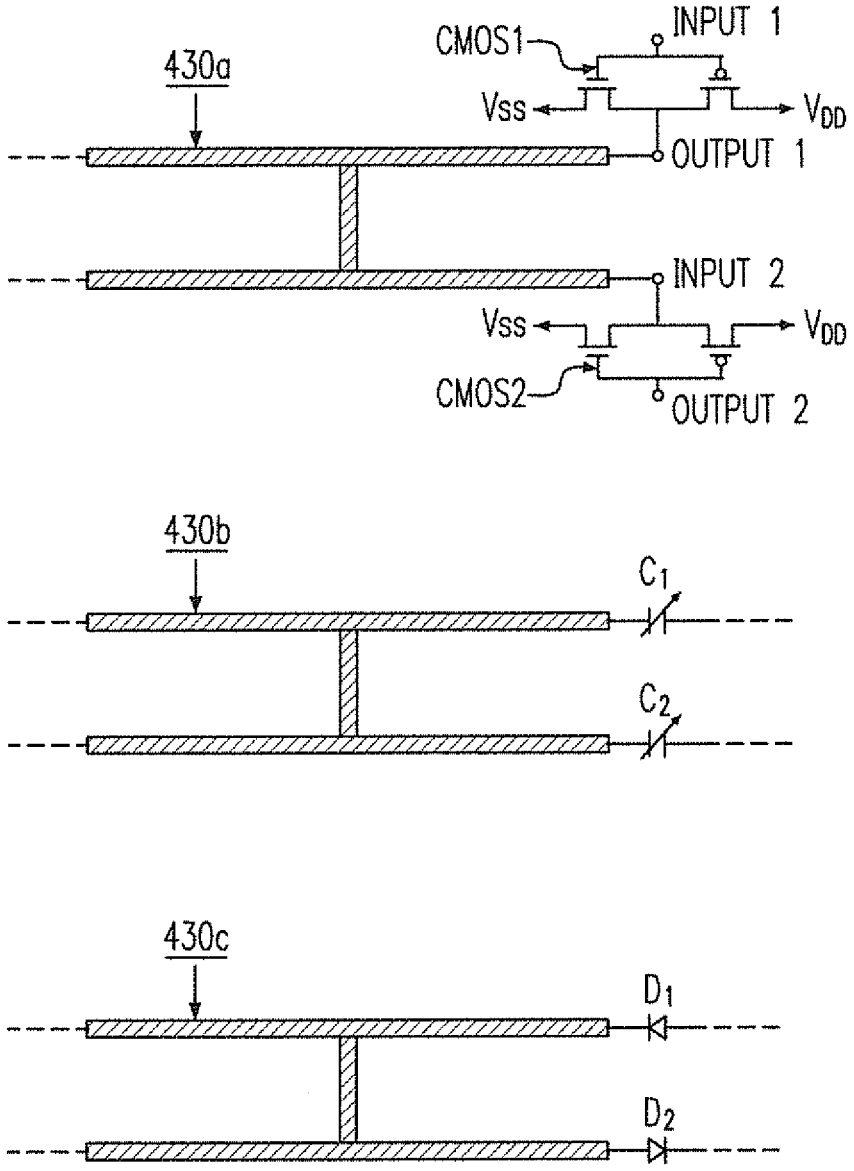
FIG. 4 is a diagram showing embodiments of connecting control elements to single-mesh structures according to the present disclosure.

FIG. 4 is a diagram showing embodiments of connecting control elements to single-mesh structures according to the present disclosure. For example, the single-mesh structure 430*a* is connected with OUTPUT 1 and OUTPUT 2 of two complementary metal-oxide-semiconductor transistors $CMOS_1$ and $CMOS_2$ and at least one control signal is fed to INPUT 1 and INPUT 2 to decide when the single-mesh structure 430*a* will form a conducting loop and to choose to connect to the single-mesh structure 430*a* to one of the AC grounds, VDD and VSS. However, in other embodiments, one of VDD or VSS or both of them can be replaced with another connecting line, for example a GND terminal or signal input terminal in the circuit.

Furthermore, the single-mesh structure 430*b* is an embodiment with the electrical connection of variable capacitors $C_1$ and $C_2$. The principle of this embodiment is to utilize the property that a larger capacitance is taken as a short circuit at high frequency for AC signals, but a smaller capacitance can still be taken as an open circuit at the high frequency. The single-mesh structure 430*c* is an embodiment with an electrical connection of diode $D_1$ and $D_2$ in different directions, and similarly, one can connect the diodes in the same direction under different design demands. In addition to the embodiment in FIG. 4, each single-mesh structure can have more conducting wires, and each conducting wire can be electrically connected to a control element or directly electrically connected to an AC ground or a DC ground in the proper situation.

Figure 5:
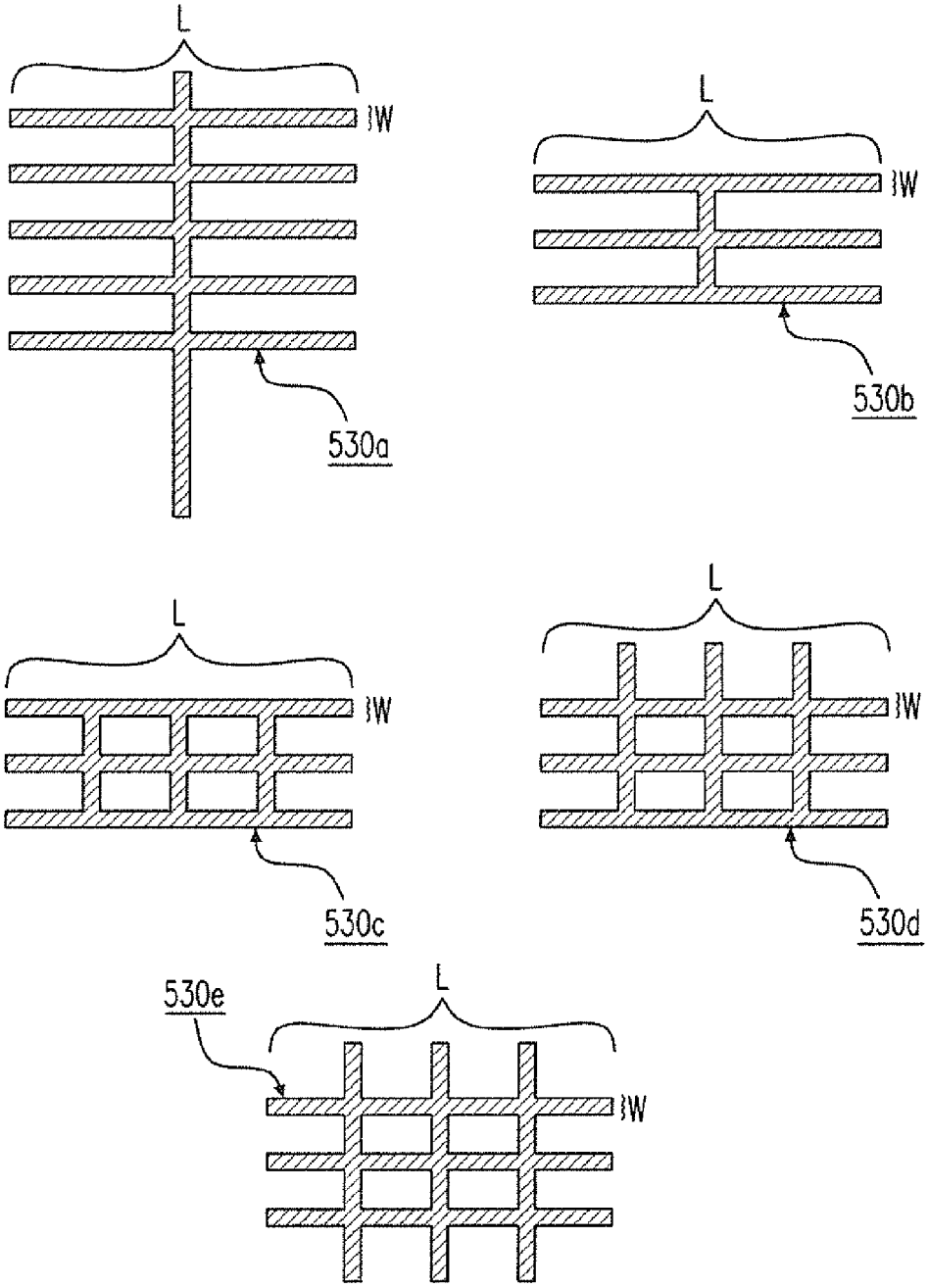
FIG. 5 is a diagram showing other different embodiments of a single-mesh structure according to the present disclosure.

FIG. 5 is a diagram showing other different embodiments of a single-mesh structure according to the present disclosure. The single-mesh structures 530*a*, 530*b*, and 530*c* can be electrically connected to the control elements or a grounding terminal through the conducting wires on the left and right sides, the single-mesh structure 530*d* can be electrically connected to the control elements or a grounding terminal through the conducting wires on the upper, left and right sides, and the single-mesh structure 530*e* can be electrically connected to the control elements or a grounding terminal through the conducting wires on the upper, lower, left and right sides. In addition, with the proof after theory and experiments, when increasing the width W and thickness (not shown) or decreasing the length L, the tuning range of the inductor is larger because the resistance can be reduced and the induced current generated by the eddy current effect in the single-mesh structure is larger, and so the tuning range can be effectively improved. Furthermore, the materials of the single-mesh structure also have some effect on the tuning range of the inductor, wherein copper conducting wire has good electrical properties and lower cost and can be a preferable choice. The width W of the single-mesh structure can range from 1.0 μm to 30.0 μm (micron meter), and the thickness can range from 0.05 μm to 5.0 μm. All the configurations of the embodiments in FIG. 5 can be applied to all the embodiments having single-mesh structures according to the present disclosure.

Figure 6A:
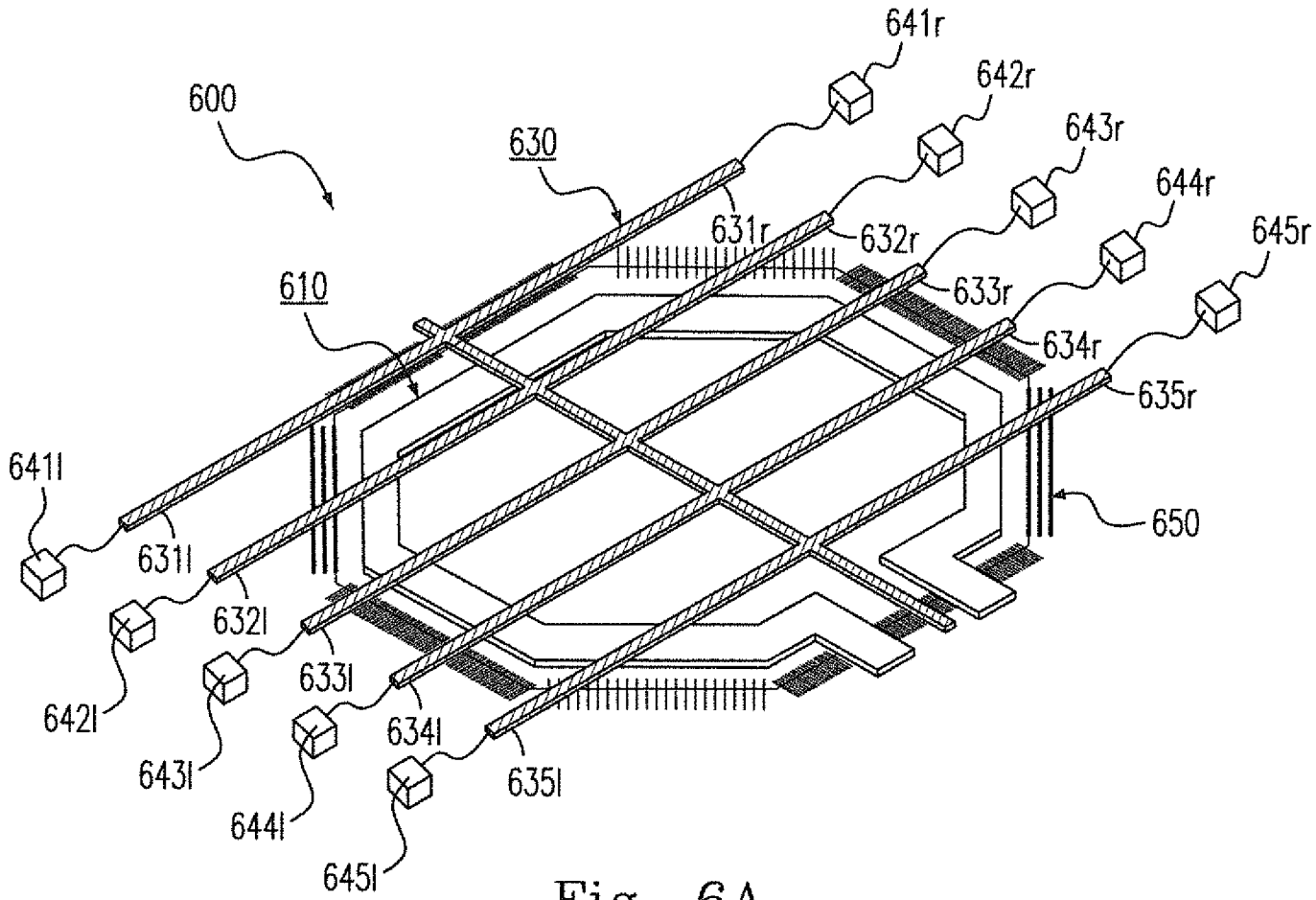
FIG. 6A is a diagram showing a preferable embodiment of a variable inductor according to the present disclosure.
Figure 6B:
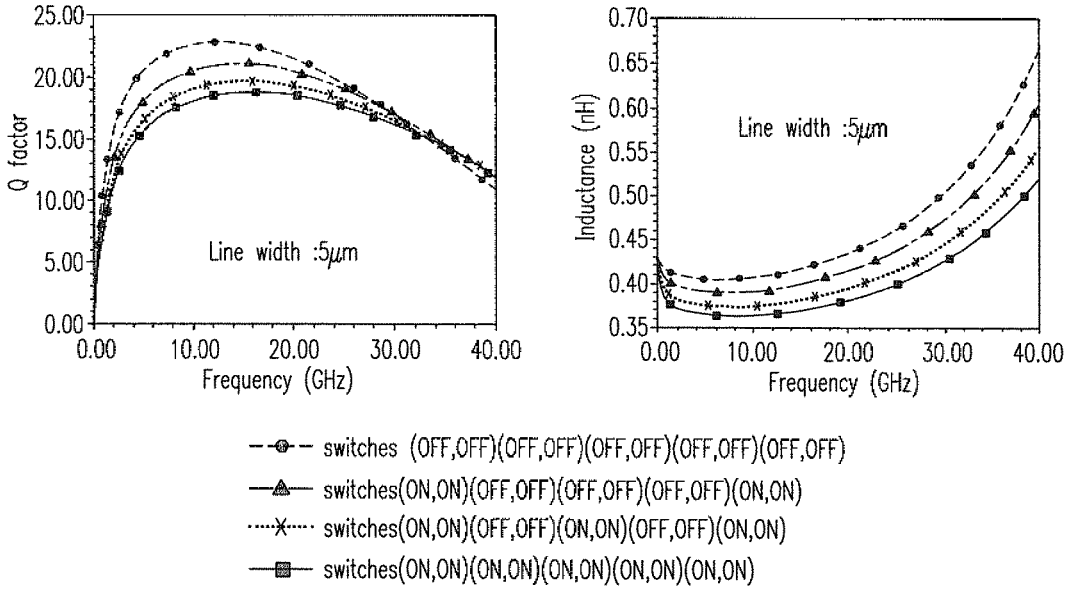
FIG. 6B is a diagram showing experimental data for a preferable embodiment of a variable inductor according to the present disclosure.

FIG. 6A is a diagram showing a preferable embodiment of a variable inductor according to the present disclosure. The variable inductor 600 includes an inductor 610 symmetrical from left to right, a symmetrical single-mesh structure 630, and a guard ring 650. The single-mesh structure 630 has five pairs of conducting wires (631*l*, 631*r*), (632*l*, 632*r*), (633*l*, 633*r*), (634*l*, 634*r*), and (635*l*, 635*r*) on the left and right sides so as to form eight grids. The conducting wires are configured to form loops with grounding terminal(s) through switches (641*l*, 641*r*), (642*l*, 642*r*), (643*l*, 643*r*), (644*l*, 644*r*), and (645*l*, 645*r*). In addition, the parameter setting of the single-mesh structure 630 is that the width is 5 μm, the thickness is 2.8 μm. In a first state, the switches are configured as (OFF, OFF), (OFF, OFF), (OFF, OFF), (OFF, OFF), (OFF, OFF). FIG. 6B is a diagram showing the experimental data for the variable inductor 600. In view of FIG. 6B, the equivalent inductance of the inductor 610 is a nominal inductance and the Q factor thereof is a nominal Q factor because the single-mesh structure 630 does not form a conducting loop. In a second state, the switches are configured as (ON, ON), (OFF, OFF), (OFF, OFF), (OFF, OFF), (ON, ON). In a third state, the switches are configured as (ON, ON), (OFF, OFF), (ON, ON), (OFF, OFF), (ON, ON). In a fourth state, the switches are configured as (ON, ON), (ON, ON), (ON, ON), (ON, ON), (ON, ON). In view of FIG. 6B, the decreased amount of the equivalent inductance of the inductor 610 is larger when the number of the conducting loops formed by the single-mesh structure is increased, and the Q factor is decreased at the same time. The variation of the Q factor, can be expressed as the relationship $Q=\omega L_{eq}/R_{eq}$, wherein ω is angular frequency, $L_{eq}$ is equivalent inductance, and $R_{eq}$ is serial equivalent resistance. Clearly, there is a trade off that the Q factor will decrease along with the decrease of $L_{eq}$, and according to the experimental result, there can be a 10% magnitude variation with different characteristics when the line width is changed.

Figure 6C:
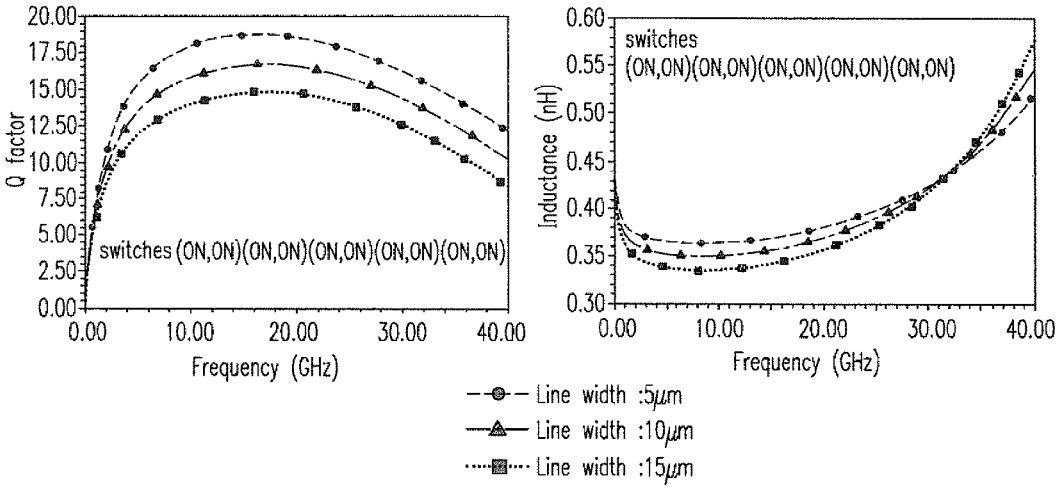
FIG. 6C is a diagram showing experimental data for a comparison among different preferable embodiments of variable inductors according to the present disclosure.

FIG. 6C is a diagram showing experimental data from a comparison among different preferable embodiments of variable inductors according to the present disclosure. This experiment is an example of the fourth state of the inductor 610 and the single-mesh structure 630, where the switches are configured as (ON, ON), (ON, ON), (ON, ON), (ON, ON), (ON, ON). Under the first line width, the single-mesh structure 630 has line width of 5 μm. Under the second line width, the single-mesh structure 630 has line width of 10 μm. Under the third line width, the single-mesh structure 630 has line width of 15 μm. Clearly, with the increase of the line width, the serial equivalent resistance will decrease, but the tuning range for the inductor 610 will increase because the current induced by the eddy current effect is larger, and when the equivalent inductance $L_{eq}$ decreases, the Q factor will decrease accordingly.

Figure 7:
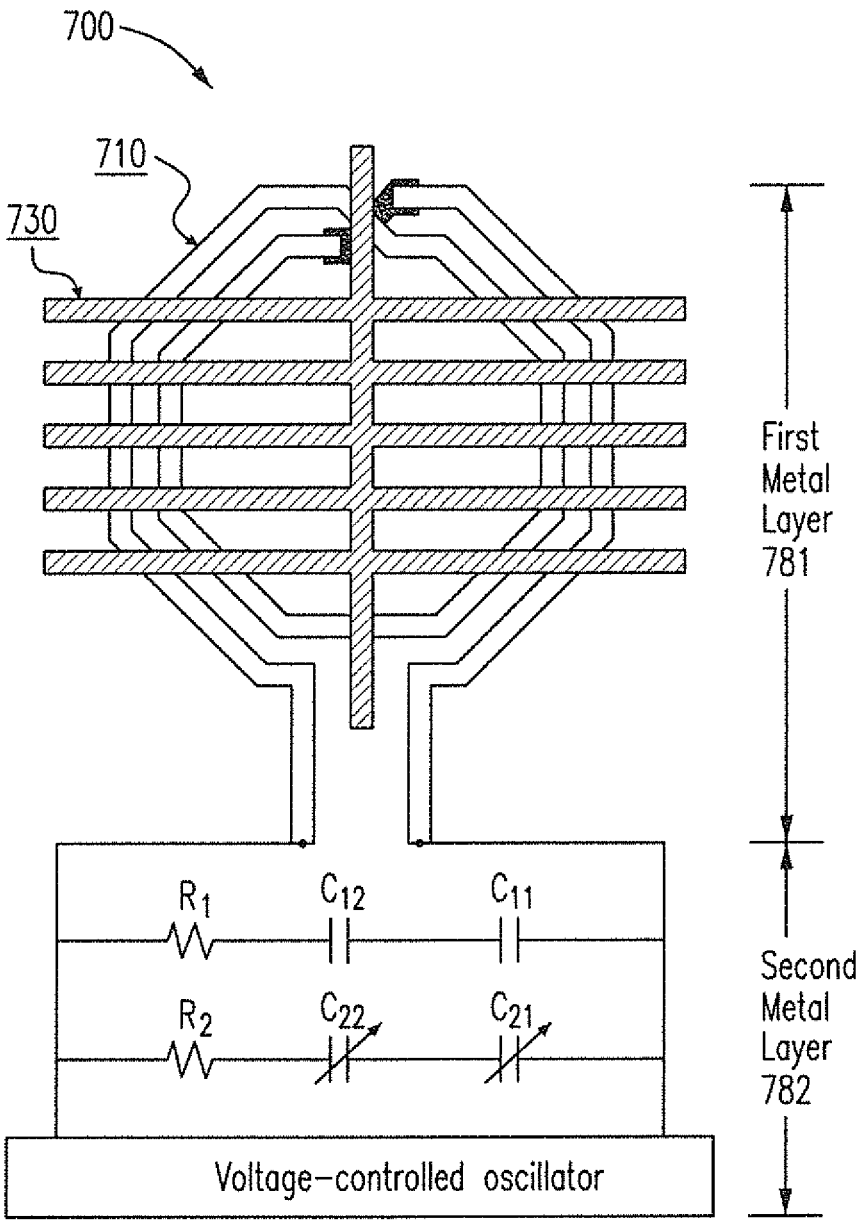
FIG. 7 is an illustration diagram showing a preferable embodiment of a voltage-controlled oscillator according to the present disclosure.

Please refer to FIG. 7, an illustration diagram showing a preferable embodiment of a voltage-controlled oscillator according to the present disclosure. The voltage-controlled oscillator 700 includes an inductor 710 and a single-mesh structure 730. The voltage-controlled oscillator 700 further includes a first metal layer 781 and a second metal layer 782 located below the first metal layer 781. The voltage-controlled oscillator 700 further includes an inductor-capacitor tank 701 including the inductor 710 and a capacitor set electrically connected to the inductor 710, wherein the capacitor set is selected from a group consisting of a fixed capacitor (e.g., $C_{11}$, $C_{12}$), a variable capacitor (e.g., $C_{21}$, $C_{22}$), and any combination thereof. The inductor 710 is located in the first metal layer 781 and the capacitor set is located in the second metal layer 782. In this embodiment, the single-mesh structure 730 of the present disclosure is applied to tune the inductance of the inductor 710. With the evolution of the process, the capacitor formed in the lower metal layer 782 (for example, a MOS capacitor formed in the M1 or M2 layer) will encounter considerably high resistance (for example, $R_1$, $R_2$), so the method of adjusting the variable capacitors $C_{21}$, $C_{22}$ to tune the frequency characteristics or Q factor of the voltage-controlled oscillator 700 becomes more and more ineffective. Therefore, adjusting the inductor 710 located in upper metal layer with lower resistance becomes an alternative. The single-mesh structure 730 is capable of finely tuning the inductance and improving the frequency characteristics, Q factor, phase noise performance, or signal synchronous transfer performance.

In another preferable embodiment, the capacitor set of the inductor-capacitor tank 701 can consist of a fixed capacitor (e.g. $C_{11}$, $C_{12}$). This embodiment has its own advantages because the variable capacitors are not any more advantageous to tune the frequency characteristics of the voltage-controlled oscillator 700 in applications of a circuit design or advanced manufacturing process above 30 GHz, the variable capacitors (e.g. $C_{21}$, $C_{22}$) can be partially or fully abandoned so as to partially or fully utilize the variable inductor formed by inductor 710 and the single-mesh structure 730. This approach can further reduce the impact of the lower metal layer having overly large resistance resulting from the evolution of the manufacturing process. For example, if capacitors $C_{21}$, $C_{22}$ are omitted, the energy loss on the serial resistance R2 can be avoided, and the Q factor of the voltage-controlled oscillator 700 can be improved.

In the present disclosure, the language "connect" or "couple" includes broad meanings of connection variations. For example, it can be a direct or indirect connection with other electrical elements, and direct or indirect coupling to other electrical elements in a circuit. The mesh structures or similar structures forming the loops can all be a stack of multiple metal layers in which every two metal layers have one or more electrical connections therebetween through a technique identical to or similar to a via, and can be disposed above and below or obliquely above and obliquely below an inductor structure.

While this disclosure has been described in terms of what is presently considered to be the most practical and preferred embodiments, it is to be understood that the disclosure is not limited to the disclosed embodiments. Therefore, it is intended to cover various modifications and similar arrangements included within the spirit and scope of the appended claims, which are to be accorded with the broadest interpretation so as to encompass all such modifications and similar structures.

What is claimed is:

1. A device having a variable inductor, comprising:
an inductor having an inductance;
a first conductor having a first grounding property;
a second conductor having a second grounding property; and
a first single-mesh structure including:
a first grid including:
a first conducting wire electrically connected to the first conductor; and
a second conducting wire electrically connected to the first conducting wire and the first conductor, wherein the first conducting wire, the second conducting wire and the first conductor are configured to form a first loop corresponding to the inductor for tuning the inductance; and
a second grid including:
a third conducting wire electrically connected to the first conducting wire and the second conductor; and
a fourth conducting wire electrically connected to the third conducting wire and the second conductor, wherein the third conducting wire, the fourth conducting wire and the second conductor are configured to form a second loop corresponding to the inductor for tuning the inductance.

2. The device as claimed in claim 1, wherein the first grid further includes a control element electrically connected between the first conducting wire and the first conductor, and the control element is one selected from a group consisting of a transistor, a complementary metal-oxide-semiconductor field effect transistor, a variable capacitor, a diode, and any combination thereof.

3. The device as claimed in claim 1, wherein the third conducting wire and the second conducting wire are the same conducting wire, and the first conductor and the second conductor are commonly grounded.

4. The device as claimed in claim 1, wherein:
the inductor includes:
at least one coil enclosing a closed area and defining an xy-plane, wherein the xy-plane is spaced and parallel with the closed area and has a center; and
a z-axis passing through the center and perpendicular to the xy-plane;
the first grid further includes:
an inclined plane defined by the first conducting wire and the second conducting wire; and
an inclined axis perpendicular to the inclined plane and deviating from a positive end of the z-axis toward the xy-plane so as to form an inclined axis angle $\theta_i$ between the inclined axis and the z-axis, wherein $\theta_i$ ranges from −90° to 90°.

5. The device as claimed in claim 1, wherein:
the inductor includes:
at least one coil enclosing a closed area and defining an xy-plane, wherein the xy-plane is spaced and parallel with the closed area and has a center;
an x-axis passing through the center and located on the xy-plane; and
a y-axis passing through the center, located on the xy-plane and perpendicular to the x-axis; and
the first grid further includes:
a first vertical straight conducting wire deviating from a positive end of the y-axis toward a negative end of the x-axis so as to form a first vertical angle $\theta_{v1}$ between the first vertical straight conducting wire and the y-axis, and having a first grid point and a second grid point;
the first conducting wire is a first horizontal straight conducting wire deviating from a positive end of the x-axis toward the positive end of the y-axis so as to form a first horizontal angle $\theta_{h1}$ between the first horizontal straight conducting wire and the x-axis, extending from the first grid point and electrically connected to the first conductor; and
the second conducting wire is a second horizontal straight conducting wire deviating from the positive end of the x-axis toward the positive end of the y-axis so as to form a second horizontal angle $\theta_{h2}$ between the second horizontal straight conducting wire and the x-axis, extending from the second grid point and electrically connected to the first conductor; and
the second grid further includes:
the first vertical straight conducting wire, wherein,
the third conducting wire is a third horizontal straight conducting wire deviating from the negative end of the x-axis toward a negative end of the y-axis so as to form a third horizontal angle $\theta_{h3}$ between the third horizontal straight conducting wire and the x-axis, extending from the first grid point and electrically connected to the second conductor; and
the fourth conducting wire is a fourth horizontal straight conducting wire deviating from the negative end of the x-axis toward the negative end of the y-axis so as to form the fourth horizontal angle $\theta_{h4}$ between the fourth horizontal straight conducting wire and the x-axis, extending from the second grid point and electrically connected to the second conductor, wherein each of $\theta_{v1}$, $\theta_{h1}$, $\theta_{h2}$, $\theta_{h3}$, and $\theta_{h4}$ ranges from −90° to 90°.

6. The device as claimed in claim 5, wherein the first grid and the second grid are located on the xy-plane, and $\theta_{v1}$, $\theta_{h1}$, $\theta_{h2}$, $\theta_{h3}$, and $\theta_{h4}$ are all 0°.

7. The device as claimed in claim 5, wherein:
the first single-mesh structure further includes a second vertical straight conducting wire located on the xy-plane, spaced and parallel with the first vertical conducting wire, and intersecting the third horizontal straight conducting line and the fourth horizontal straight conducting wire at a third grid point and a fourth grid point respectively.

8. The device as claimed in claim 1, further comprising:
a second single-mesh structure having a structure identical to the first single-mesh structure and spaced and parallel therewith so that the inductor is located between the first single-mesh structure and the second single-mesh structure.

9. The device as claimed in claim 1, wherein:

the inductor has at least one coil enclosing an inductor interior area and defining an inductor exterior area;

the first conductor and the second conductor are located in the inductor exterior area; and each of the first conducting wire, the second conducting wire, the third conducting wire, and the fourth conducting wire is a straight conducting wire extending from the inductor interior area to the inductor exterior area;

the inductor interior area includes non-overlapping cross section areas projected by the first grid and the second grid on the inductor interior area.

10. The device as claimed in claim 9, wherein:

the inductor includes a central axis symmetrically partitioning the inductor interior area into a left area and a right area;

the first single-mesh structure further includes a mesh conducting wire aligned with and parallel to the central axis; and each of the first conducting wire and the second conducting wire extends, in a direction perpendicular to the mesh conducting wire, from the mesh conducting wire, through the right area, to the inductor exterior area; and each of the third conducting wire and the fourth conducting wire extends, in a direction perpendicular to the mesh conducting wire, from the mesh conducting wire, through the left area, to the inductor exterior area.

11. The device as claimed in claim 1, further comprising:

a first metal layer acting as a redistribution layer; and a second metal layer located below and adjacent to the first metal layer, wherein:

the first single-mesh structure is formed in the first metal layer; and the inductor is formed in the second metal layer.

12. The device as claimed in claim 1, further comprising:

a metal layer including the inductor;

a ground layer located below the metal layer and including the first conductor and the second conductor; and a first guard ring located between the metal layer and the ground layer and electrically connected to the ground layer, the first conducting wire and the second conducting wire.

13. The device as claimed in claim 12, wherein the metal layer further includes a second guard ring surrounding the inductor.

14. The device as claimed in claim 1, wherein the device is a voltage-controlled oscillator, and further comprises:

a first metal layer;

a second metal layer located below the first metal layer; and an inductor-capacitor tank including:

the inductor located in the first metal layer; and a capacitor located in the second metal layer and electrically connected to the inductor, wherein the capacitor is selected from a group consisting of a fixed capacitor, a variable capacitor, and any combination thereof.

15. The device as claimed in claim 14, wherein the inductor-capacitor tank consists of the inductor and the fixed capacitor electrically connected to the inductor.

* * * * *